US008082704B2

(12) United States Patent
Stroppiana

(10) Patent No.: US 8,082,704 B2
(45) Date of Patent: Dec. 27, 2011

(54) SPORTS FLOORING

(75) Inventor: Fernando Stroppiana, Grinzane Cavour (IT)

(73) Assignee: MONDO S.p.A., Alba Frazione Gallo (Cueno) (IT)

( * ) Notice: Subject to any disclaimer, the term of this patent is extended or adjusted under 35 U.S.C. 154(b) by 0 days.

(21) Appl. No.: 12/132,410

(22) Filed: Jun. 3, 2008

(65) Prior Publication Data

US 2009/0110874 A1 Apr. 30, 2009

(30) Foreign Application Priority Data

Oct. 30, 2007 (EP) ..... 07425686

(51) Int. Cl.
*E04F 15/00* (2006.01)

(52) U.S. Cl. ..... 52/177; 52/403.1; 428/116; 428/119

(58) Field of Classification Search ..... 52/177, 52/403.1, 480, 179–181, 302.1, 418; 428/98, 428/156, 172, 221, 323, 327, 537.1, 537.5, 428/116, 118, 119
See application file for complete search history.

(56) References Cited

U.S. PATENT DOCUMENTS 4,172,168 A * 10/1979 Klaffke et al. ..... 428/138
4,986,860 A * 1/1991 Akimoto et al. ..... 156/78
6,069,184 A * 5/2000 Bleys et al. ..... 521/159
6,623,840 B2 * 9/2003 Hainbach ..... 428/172
7,096,630 B1 * 8/2006 Keene et al. ..... 52/309.8
7,114,298 B2 * 10/2006 Kotler ..... 52/177

FOREIGN PATENT DOCUMENTS

| | | | |
|---|---|---|---|
| EP | 0913524 | A1 | 5/1999 |
| EP | 1096080 | A2 | 5/2001 |
| EP | 1096080 | A3 | 1/2003 |
| EP | 0913524 | B1 | 8/2004 |
| EP | 1096080 | B1 | 6/2006 |
| GB | 2000726 | A | 1/1979 |
| JP | 2001000616 | | 1/2001 |

OTHER PUBLICATIONS

European Search Report for corresponding EP Application No. 07425686 dated Mar. 26, 2008.

* cited by examiner

*Primary Examiner* — David Dunn
*Assistant Examiner* — Adam Barlow
(74) *Attorney, Agent, or Firm* — Heslin Rothenberg Farley & Mesiti P.C.; Victor A. Cardona, Esq.

(57) ABSTRACT

A flooring, preferentially designed to be used for laying running tracks, includes a treading layer constituted by an elastomer mass and a supporting layer also constituted by an elastomer mass. The supporting layer has, on the side opposite to the treading layer, an array of cavities delimited by ribbings constituting a mesh of uniform ribbings. The cavities are cavities having an elongated shape in the direction of running on the flooring. The cavities occupy a volume equal to at least 28%, and preferentially at least 30%, of the volume of the supporting layer.

16 Claims, 2 Drawing Sheets

SPORTS FLOORING

CROSS REFERENCE TO RELATED APPLICATIONS

This application claims priority from European Patent application No. 07425686.8, filed on Oct. 30, 2007, the entire disclosure of which is incorporated herein by reference.

FIELD OF THE INVENTION

The present invention relates to sports floorings, for use, for example, for making athletics tracks, in particular for running.

DESCRIPTION OF THE PRIOR ART

Documents such as EP-A-0 913 524 or EP-A-1 096 080, both filed in the name of the present applicant, describe sports floorings comprising a treading layer constituted by an elastomer mass and a supporting layer, which is also constituted by an elastomer mass. The supporting layer has, on its underside, i.e., on the side opposite to the treading layer, supporting ribbings of various nature.

Floorings of the type specified above have encountered over the years widespread use in sports facilities, such as sports grounds, stadia and gymnasia, and facilities, such as gymns for fitness or medical and physiotherapy centres, or the like.

Such floorings are made, for example, starting from mixes of elastomers through one or more cascaded operations of calendering. In this way, it is possible to bestow upon the top face of the treading layer an as a whole corrugated pattern, with protrusions that primarily perform an anti-slip function.

In particular, FIG. 1 of both of the documents Nos. EP-A-0 913 524 and EP-A-1 096 080 illustrate, as representative of the respective prior art, a sports flooring comprising a treading layer constituted by an elastomer mass and a supporting layer that is also constituted by an elastomer mass, wherein the supporting layer has, on the side opposite to said treading layer, an array of cavities delimited by ribbings constituting a mesh of ribbings substantially uniform with respect to one another. That prior art has been taken as a model for the preamble of claim 1 of the present patent application.

In the solution that forms the specific subject of the document EP-A-0 913 524, the underside of the flooring is provided with transverse ribbings connected to one another by longitudinal ribbings substantially resembling formations that extend like bridges connecting adjacent transverse ribbings. The transverse ribbings are arranged inclined (i.e., oblique) with respect to the treading layer. In this way, i.e., resorting to a non-uniform mesh of ribbings, in so far as comprising two different types of ribbings, it is possible to create floorings that have characteristics of compliance (understood normally in the sense of a resilience of an elastic type) that are differentiated according to the direction of running on the flooring.

Also, in the solution that forms the specific subject of the document EP-A-1 096 080 ribbings are provided arranged inclined with respect to the treading layer. These inclined ribbings, arranged in pairs, contribute to forming structures of suction-cup anchorage for the flooring. These inclined ribbings contribute, otherwise only to an altogether marginal extent, to the characteristics of elastic compliance and hence to the function of support of the flooring. This function is, instead, entrusted primarily to other ribbings extending in a direction substantially normal to said treading layer. In this regard, it should be also noted that the sports flooring forming the specific subject matter of the document EP-A-1 096 080 has not been developed for its use for fast running, even of a competitive type.

Of course, talking of sports floorings for running, the terms "transverse" and "longitudinal" are understood as referring to the direction of running (or walking) on the flooring. The direction of running can be identified in a certain and unique way in so far as the floorings in question are usually produced in the form of sheets wound in rolls. The sheets are wound off the rolls and laid "lengthwise" alongside one another, with the longitudinal direction of the sheet that extends precisely in the direction of running. This direction usually corresponds also to the direction in which the operation of calendering is performed.

In any case, the solutions that form the specific subject of the documents EP-A-0 913 524 and EP-A-1 096 080 are characterized precisely by the fact that the cavities provided on the underside of the supporting layer are delimited by ribbings that constitute a non-homogeneous (or non-uniform) mesh, in the sense that said mesh comprises ribbings of different nature (inclined/not inclined), with different functions (supporting ribbings/anchoring ribbings) and/or with different characteristics of compliance.

Over the years there have been developed instruments and procedures that enable identification in a quantitatively precise way of the characteristics of a flooring of the type described above. For example, the standard UNI EN 14808 enables definition of a parameter, referred to as "force reduction" (FR), which corresponds substantially to a characterization, in percentage terms, of the behaviour of the flooring subjected to the fall of a weight of standard dimensions, referred to the behaviour manifested by a rigid surface, typically made of cement, in regard to the same stress.

The floorings for use for sports activities, in particular for laying athletics tracks, usually have a value of FR comprised between approximately 35% and 50%. The lower value corresponds to a flooring characterizable as rather "hard", whilst the upper limit corresponds to a flooring that proves rather "soft" in regard to the stress due to treading or running.

There remains in any case the fact that the acid test of the quality and features of a flooring for sports activities is represented by the use, i.e., by the interaction with the body of the athlete. The modalities of interaction can be different, not only according to the sports activity practised, but also according to the style of running adopted by the individual athlete. The interaction of the foot of the athlete with the track on which the athlete is running is not only in a longitudinal direction, i.e., in the direction of running, but implies also a movement of transverse "roll", corresponding to a sort of movement of rotation of the sole of the foot from the fifth to the first metatarsus in a vertical plane transverse to the direction of running. Again, whilst a "soft" flooring can be perceived by some athletes as a "restful" flooring, the softness must not be perceived as penalizing for the athlete, in terms, for example, of spurt, which would lead, instead, to privileging a track that is somewhat rigid, such as to optimize the transmission of the propulsion thrust exerted by the athlete towards the ground.

OBJECT AND SUMMARY OF THE INVENTION

The object of the present invention is to provide a flooring of the type described above, that is able to respond in an altogether satisfactory way to these requirements, which in themselves are in contrast with one another, avoiding, for example, the need to envisage for that purpose different directions of running as in the case of the flooring described in EP-A-0 913 524.

According to the present invention, that object is achieved thanks to a flooring, as defined in claim 1. Preferred embodiments are defined in the dependent claims.

The claims form an integral part of the disclosure of the invention provided herein.

In a possible embodiment, the solution described herein corresponds to a sports flooring comprising a treading layer constituted by an elastomer mass and a supporting layer which is also constituted by an elastomer mass, wherein the supporting layer has, on the side opposite to the treading layer, an array of cavities delimited (surrounded) by ribbings forming a mesh of ribbings that are uniform. It is, therefore, a homogeneous mesh, wherein, for example, the ribbings all function as formations for supporting the flooring and/or project by one and the same amount in a direction substantially normal to the treading layer. In one embodiment, the cavities are cavities having an elongated shape, the major dimension of which is aligned with the direction of running on the flooring.

In one embodiment, the cavities occupy a volume equal to at least 28%, and preferentially at least 30%, of the volume of said supporting layer.

The aforesaid value of at least 28-30% (a value that is clearly higher than the value to be found in the sports floorings commonly used for running) would lead to evaluating said flooring as a rather soft flooring, which can be perceived as excessively "slow" by the athletes engaged in running.

Albeit without wishing to be tied down to any specific theory in this connection, the present applicant has reasons to believe that the elongated shape of the cavities (for example, irregular hexagon or rhombus, in plan view), oriented with the major dimension aligned with the direction of running on the flooring, leads the aforesaid softness to be present principally in a direction transverse to the direction of running, facilitating—in a way acceptable for the athlete—the aforesaid movement of "roll", without this undermining the desired features of higher rigidity, which consequently favour "spurt" on the part of the athlete, in the direction of running.

As shown by some tests documented in the rest of the present description, the solution described herein enables results in term of performance better than those obtained with commonly used floorings to be achieved. This is obtained using a flooring wherein the supporting layer wherein has a mesh of uniform ribbings, which also entails, at a production level, the advantage linked to the fact of preventing the need for ribbings having differentiated characteristics.

BRIEF DESCRIPTION OF THE ANNEXED DRAWINGS

The invention will now be described, purely by way of non-limiting example, with reference to the annexed drawings, in which.

DETAILED DESCRIPTION OF AN EXEMPLARY OF EMBODIMENT

Figure 1:
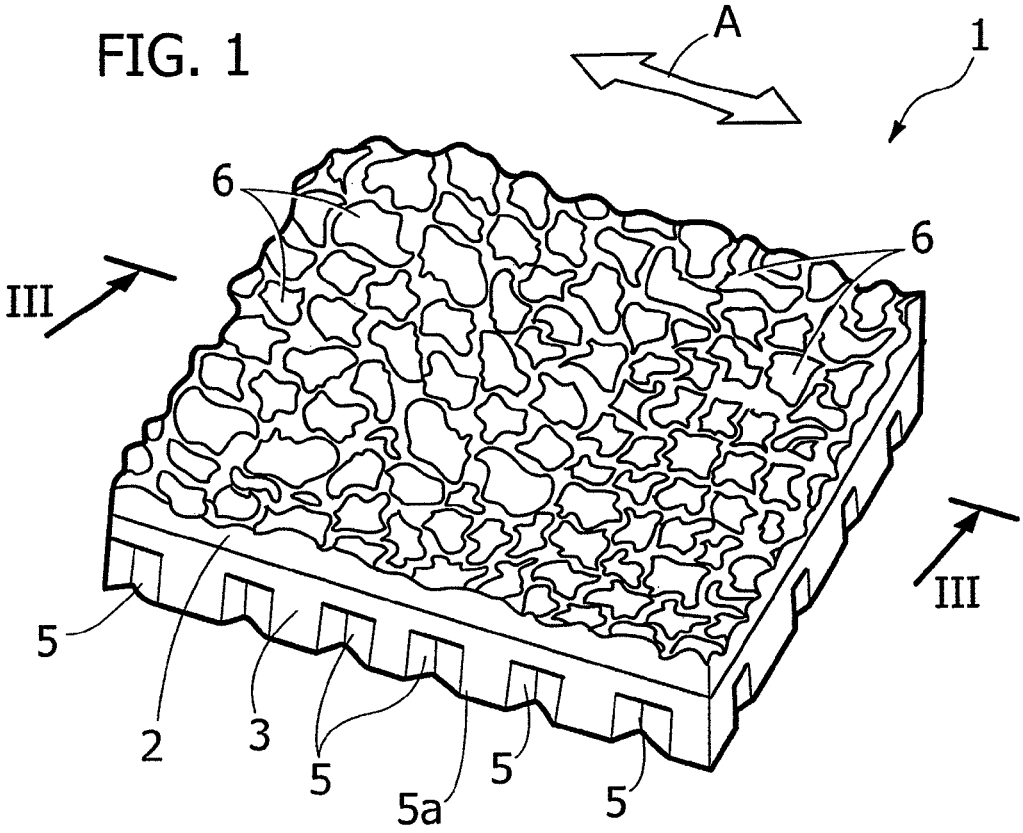
FIG. 1 is a perspective view of a portion of flooring of the type described herein.

As indicated, FIG. 1 is a perspective view of a portion of flooring 1, comprising, in a way in itself known:

a treading layer 2 (designed to face upwards when the flooring 1 is laid) constituted by an elastomer mass; and a supporting layer 3 (designed to face downwards when the flooring 1 is laid) which is also constituted by an elastomer mass.

The two layers 2 and 3 are connected to one another—usually during the operation that leads to the formation of the flooring 1—in a plane of connection 4 (see FIG. 3) that defines a surface of interface between the two layers 2 and 3.

The supporting layer 3 has, on the side opposite to the treading layer 2, hence on the side designed to face the substrate on which the flooring 1 is laid, an array of cavities 5. The cavities are open precisely on the underside of the flooring 1 so as to be delimited (surrounded) by ribbings 5*a*, which have a height (and, in the present case, also a width) that is uniform and extend in a direction substantially orthogonal to the treading layer 2 so as to constitute a regular (for example reticular) mesh of supporting ribbings of the flooring 1 that are uniform with respect to one another.

Both the treading layer 2 and the supporting layer 3 are constituted by elastomers. In one embodiment, these are mixes of elastomers (e.g., mixes of isoprene rubbers) substantially homogeneous with respect to one another but with slightly different formulations.

In one embodiment, the treading layer 2 is made of an elastomer having a Shore A hardness (according to ISO 7619) of 55+/−2 and a mass per unit volume (according to UNI EN 436) of 1100+/−50 kg/m$^3$.

In one embodiment, the supporting layer 3 is of an elastomer having a Shore A hardness (according to ISO 7619) of 40+/−2 and a mass per unit volume (according to UNI EN 436) of 1000+/−50 kg/m$^3$.

A flooring of the type considered herein can be made using the same criteria and principles commonly used for laying similar floorings according to the prior art. These criteria and principles hence do not need to be recalled explicitly herein.

For instance, it is possible to use a process of simple calendering or else one envisaging a number of stages as a whole identical to the ones used for the production of the floorings according to the prior art. This applies also as regards the formation of the cavities 5 of the supporting layer 3 and of the protrusions 6 present on the top face of the treading layer 2, according to the modalities described more fully in what follows. Basically, the cavities 5 and the protrusions 6 can be formed by providing on the calendering rollers shapings corresponding and complementary to the cavities 5 and to the protrusions 6.

Figure 3:
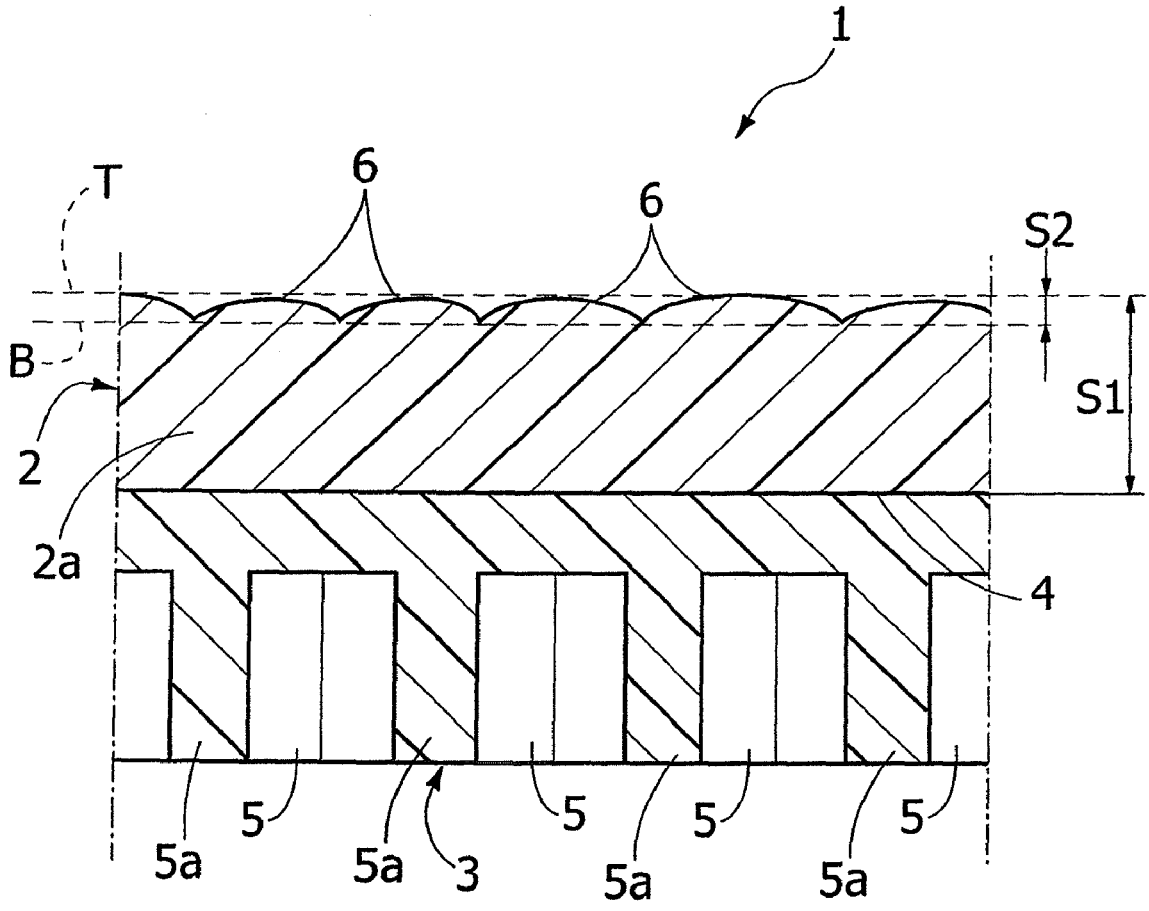
FIG. 3 is a cross-sectional view according to the line III-III of FIG. 1, reproduced at a slightly enlarged scale with respect to FIGS. 1 and 2 in order to highlight more effectively some aspects not directly perceptible in FIGS. 1 and 2.

Purely by way of non-limiting reference, the flooring 1 illustrated in the figures can present the following dimensional characteristics (measured in the absence of applied loads):

overall thickness (measured between the bottom surface of the supporting layer 3 and the crest plane T of the protrusions 6): 13 mm—value according to the rules of the International Amateur Athletic Federation (IAAF);

thickness of the treading layer 2 (measured between the plane of connection 4 and the crest plane T—S1 in FIG. 3): 6.5 mm;

thickness of the supporting layer 3 (measured between the bottom surface of the supporting layer 3 and the plane of connection 4): 6.5 mm.

Figure 2:
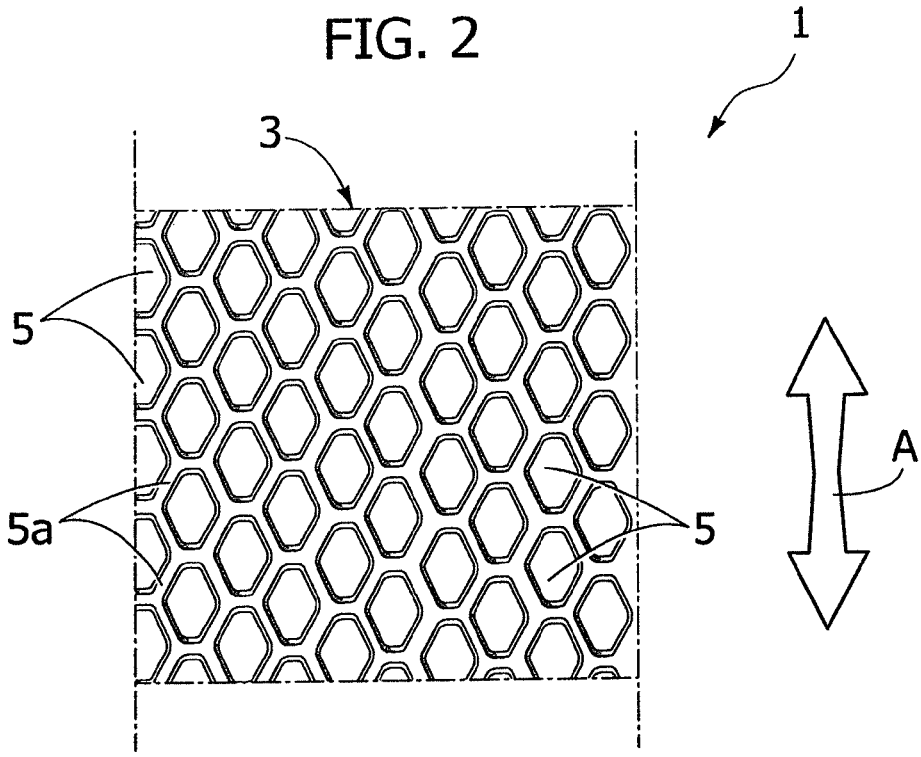
FIG. 2 is a view from beneath of a portion of flooring of the type described herein.

The view from beneath of FIG. 2 shows that the cavities 5 are cavities having an elongated shape (for example, having a hexagonal or rhomboidal shape, in plan view). They are hence cavities in which it is in any case possible to distinguish a major dimension (length) and at least one minor dimension (width) with the length appreciably greater than the width.

The cavities 5, made in the supporting layer 3 so as to be delimited by ribbings constituting a uniform mesh of ribbings, have their major dimension or length of the cavities 5 aligned with the direction of running on the flooring.

As already explained in the introductory part of the present description, said direction, indicated by the double-headed arrow A in FIGS. 1 and 2, can be identified in a certain and unique way in so far as the floorings referred to are usually produced in the form of sheets wound in rolls. The sheets are wound off the rolls and laid lengthwise, alongside one another, with the longitudinal direction of each sheet that extends precisely in the direction of running. The direction A usually corresponds also to the direction in which the operation of calendering is performed.

For direct comparison, the solution that forms the specific subject of EP-A-1 096 080 envisages the presence, in the supporting layer, of elongated cavities that are in themselves likely to be oriented in the direction of walking or of running on the flooring. The elongated cavities illustrated in EP-A-1 096 080 are, however, delimited on their larger sides by inclined and very compliant ribbings (in so far as they must function as anchoring suction cups), altogether non-uniform with respect to the other ribbings present in the supporting layer.

In one embodiment of the solution described herein, the cavities 5 occupy a volume equal to at least 28% and preferentially at least 30% of the volume of the supporting layer 3.

As used herein, "volume of the supporting layer 3" means the overall volume or envelope volume of said supporting layer 3, i.e., the volume that the layer 3 would have if it were full, i.e., without the cavities 5.

The aforesaid overall volume or envelope volume is represented by the product of the area of the portion of layer 3 considered and the thickness of the layer 3 itself, a thickness that is measured, as already mentioned, between the bottom surface of the supporting layer 3 and the plane of connection 4.

Thus, a portion of supporting layer 3 of equal dimensions, for example, 10×10 cm, hence with an area of 100 $cm^2$ and with a thickness, for example, of 6.5 mm (0.65 cm) will have an overall volume or envelope volume equal to 65 $cm^3$.

The part of volume of the supporting layer 3 occupied by the cavities 5 can be readily determined experimentally by taking a portion of supporting layer 3, set with the cavities 5 facing upwards and filling the cavities 5 themselves with a flowable material, such as dry sand, having a given (apparent) density. It may be, for example, standardized sand according to the standard UNI EN 772-9.

Once the filling of sand has been smoothed so that it will occupy only the cavities 5, the portion of supporting layer 3 is turned upside down so as to orient the cavities 5 downwards, gathering the sand that comes out of the cavities 5. The sand gathered is weighed, and the volume occupied by the cavities 5 is calculated as a ratio between the weight of the sand gathered and the density of the sand itself.

The volume occupied by the cavities 5 thus calculated can then be referred (e.g., in percentage terms) to the overall volume or envelope volume of the supporting layer 3.

In a possible embodiment, the cavities 5 (herein exemplified as cavities having a hexagonal or rhomboidal shape in plan view) present a ratio between major dimension (length) and minor dimension (width) of at least 1.5 and preferentially of approximately 1.7.

In one embodiment, once again as illustrated, the cavities 5 are arranged in a quincunx fashion and define a honeycomb structure, which renders even more evident the characteristics of substantial homogeneity of the mesh of the ribbings 5*a*, which are uniform with respect to one another and surround the cavities 5 themselves.

In one embodiment, the cavities form a continuous array that extends over the entire surface of the supporting layer 3.

In one embodiment, the cavities 5 are present in a number of between 8400 and 9100 cavities per square meter of flooring 1.

In one embodiment, the cavities 5, instead of being cavities open on the side opposite to the treading layer 2, as illustrated herein, could be lidded cavities, i.e., cavities closed by a lid.

In one embodiment, as illustrated, the treading layer 2 comprises:

an internal part 2*a*, with a continuous structure, connected to the supporting layer 3 in a position corresponding to the plane of connection 4; and an external part, opposite to the supporting layer 3, provided with a surface shaping, represented by the presence of the protrusions 6 that extend between a root plane B, corresponding to the interface with the internal part 2*a*, and the crest plane T.

In one embodiment, the height or projection of the protrusions 6, i.e., the distance between the root plane B and the crest plane T (distance designated by S2 in FIG. 3) is equal to at least 30%, and preferentially approximately 33%, of the thickness S1 of the treading layer 2, measured, as already said, between the plane of connection 4 and the crest plane T of the protrusions 6.

The values mentioned correspond therefore to a rather marked degree of surface shaping, which is able to valorize further the performance documented in what follows.

In one embodiment, the protrusions 6 are present in a number of between 24000 and 26000 protrusions per square meter of flooring 1.

The ensuing tables refer to tests of comparison conducted with the aid of two athletes (I and II) engaged in a fast race of 50 meters in length. The comparison was made by getting the two athletes to run on a flooring of the type described herein and on a reference flooring according to EP-A-0 913 524, used in the direction of running, indicated therein as preferential for fast running (FIG. 5). The tables refer to measurements made between the 40th and 46th meter of running with the, speed and step measuring equipment. OPTOJUMP™, commercially available from the company MICROGATE S.r.l. of Bolzano (ITALY) as described in their website www.microgate.it.

TABLE 1

| Athlete I | | |
|---|---|---|
| Parameter | Track described herein | Reference track |
| Total time (s) | 3.576 | 3.564 |
| Contact time (s) | 0.110 | 0.104 |
| Time of flight (s) | 0.116 | 0.123 |
| Rhythm (steps/s) | 4.42 | 4.41 |
| Length of step (cm) | 208 | 202 |
| Speed (m/s) | 9.20 | 8.90 |

TABLE 2

| Athlete II | | |
|---|---|---|
| Parameter | Track described herein | Reference track |
| Total time (s) | 3.552 | 3.584 |
| Contact time (s) | 0.110 | 0.123 |

TABLE 2-continued

| Athlete II | | |
|---|---|---|
| Parameter | Track described herein | Reference track |
| Time of flight (s) | 0.116 | 0.134 |
| Rhythm (steps/s) | 4.42 | 3.89 |
| Length of step (cm) | 220 | 211 |
| Speed (m/s) | 9.73 | 8.21 |

The comparative tests documented above reveal a clear improvement in relation to all the parameters considered, which is accompanied by a very favourable appreciation on the part of the athletes involved in the tests.

The value of the parameter FR measured for the two floorings set in comparison is respectively equal to 41-42% (track described herein) and 36-37% (reference track). These values of FR would have led to forecasting better results for fast running for the harder track (FR 36-37%), a forecast that proves, instead, surprisingly in contrast with what has emerged from the tests.

The choice of providing the treading layer 2 with a material substantially similar, even though usually with different formulation, to the material constituting the supporting layer 3 does not constitute a mandatory solution.

All the quantitative values indicated in the present description and in the ensuing claims are of course to be interpreted taking into account the tolerances normally associated to their determination and to their measurement.

Without prejudice to the principle of the invention, the details of construction and the embodiments may vary widely with respect to what is described and illustrated herein, without thereby departing from the scope of the present invention, as defined by the annexed claims.

What is claimed is:

1. A sports flooring for running tracks in the form of a sheet wound lengthwise in a roll, the flooring comprising:

a treading layer comprising an elastomer mass, a supporting layer, comprising an elastomer mass, in which said supporting layer has, on the side opposite to said treading layer, an array of cavities delimited by ribbings comprising a mesh of uniform ribbings and each cavity of said array of cavities having a longitudinal dimension aligned with and elongated in a direction of a longitudinal dimension of said supporting layer, said longitudinal dimension of said supporting layer being aligned with a longitudinal winding direction of the flooring sheet, wherein said cavities are present in a number of between 8400 and 9100 cavities per square meter of flooring.

2. The flooring according to claim 1, wherein said cavities occupy a volume equal to at least 28% of the volume of said supporting layer.

3. The flooring according to claim 1, wherein said cavities occupy a volume equal to at least 30% of the volume of said supporting layer.

4. The flooring according to any one of claim 1, wherein said cavities have an elongated shape with a ratio between the major dimension and the minor dimension equal to at least 1.5.

5. The flooring according to claim 4, wherein each cavity of said array of cavities has an elongated shape with a ratio between the major dimension and the minor dimension of approximately 1.7.

6. The flooring according to claim 1, wherein each cavity of said array of cavities has a hexagonal shape.

7. The flooring according to claim 1, wherein said cavities form a continuous array that extends over the entire surface of the supporting layer.

8. The flooring according to claim 1, wherein said cavities form a honeycomb structure.

9. The flooring according to claim 1, wherein said cavities are cavities open on the side opposite to said treading layer.

10. The flooring according to claim 1, wherein said treading layer comprises:

an internal part connected to said supporting layer in a plane of connection; and an external part, opposite to said supporting layer, with protrusions extending with respect to said internal part between a root plane and a crest plane, and in which the distance between said root plane and said crest plane is equal to at least 30% of the thickness of said treading layer measured between said plane of connection and said crest plane.

11. The flooring according to claim 10, wherein the distance between said root plane and said crest plane is equal to approximately 33% of the thickness of said treading layer.

12. The flooring according to claim 10, wherein said protrusions are present in a number of between 24000 and 26000 protrusions per square meter of flooring.

13. The flooring according to claim 1, wherein said treading layer is of an elastomer having a Shore A hardness (according to ISO 7619) of 55+/−2 and a mass per unit volume (according to UNI EN 436) of 1100+/−50 kg/m$^3$.

14. The flooring according to claim 1, wherein said supporting layer is of an elastomer having a Shore A hardness (according to ISO 7619) of 40+/−2 and a mass per unit volume (according to UNI EN 436) of 1000+/−50 kg/m$^3$.

15. An athletics track, in particular for running, provided with a flooring according to claim 1.

16. A sports flooring comprising:

a plurality of flooring sheets having longitudinal dimensions, said longitudinal dimensions longitudinally aligned such that each flooring sheet of said plurality of flooring sheets is longitudinally aligned with each other flooring sheet of said plurality of flooring sheets;

each flooring sheet of said plurality of flooring sheets comprising:

a treading layer comprising an elastomer mass, and a supporting layer, comprising an elastomer mass, in which said supporting layer has, on the side opposite to said treading layer, an array of cavities delimited by ribbings comprising a mesh of uniform ribbings, each cavity of said array of cavities having a longitudinal dimension aligned with and elongated in a longitudinal direction of each flooring sheet, wherein said cavities are present in a number of between 8400 and 9100 cavities per square meter of flooring.

* * * * *